US009273916B1

(12) United States Patent
Russo

(10) Patent No.: US 9,273,916 B1
(45) Date of Patent: Mar. 1, 2016

(54) FIREARM IMPINGEMENT SYSTEM HAVING ADJUSTABLE GAS BLOCK

(71) Applicant: Carmelo Russo, Port Richey, FL (US)

(72) Inventor: Carmelo Russo, Port Richey, FL (US)

( * ) Notice: Subject to any disclaimer, the term of this patent is extended or adjusted under 35 U.S.C. 154(b) by 0 days.

(21) Appl. No.: 14/588,999

(22) Filed: Jan. 5, 2015

(51) Int. Cl.
*F41A 5/28* (2006.01)
*F41A 5/26* (2006.01)

(52) U.S. Cl.
CPC .... *F41A 5/26* (2013.01); *F41A 5/28* (2013.01)

(58) Field of Classification Search
CPC ..... F41A 5/18–5/28
USPC ..... 89/193
See application file for complete search history.

(56) References Cited

U.S. PATENT DOCUMENTS 2,003,066 A * 5/1935 Brondby ..... F41A 5/26 89/193
2,783,685 A * 3/1957 Green ..... F41A 5/28 297/248
2,872,851 A * 2/1959 Katz ..... F41A 5/28 89/193
2,941,450 A * 6/1960 Crittendon ..... F41A 5/28 89/191.01
4,244,273 A * 1/1981 Langendorfer, Jr. ..... F41A 5/28 89/193
5,272,956 A * 12/1993 Hudson ..... F41A 5/28 42/72
7,610,844 B2 * 11/2009 Kuczynko ..... F41A 5/28 89/193
7,891,284 B1 * 2/2011 Barrett ..... F41A 5/28 89/14.4
8,261,653 B2 * 9/2012 Crommett ..... F41A 5/28 89/191.01
8,528,458 B2 * 9/2013 Windauer ..... F41A 5/26 89/193
8,813,632 B2 * 8/2014 Adams ..... F41A 5/28 89/191.01
8,863,639 B2 * 10/2014 Gomez ..... F41A 5/18 89/191.01
2009/0229454 A1 * 9/2009 Fluhr ..... F41A 5/28 89/193

* cited by examiner

*Primary Examiner* — Troy Chambers
*Assistant Examiner* — Joshua Semick
(74) *Attorney, Agent, or Firm* — Gulf Coast Intellectual Property Group

(57) ABSTRACT

A firearm impingement apparatus that is operable to divert a portion of the gas flowing into the gas block of the impingement apparatus so as to reduce the temperature and contamination thereof. The impingement apparatus includes a gas block integrally formed with a barrel-mating sleeve. The gas block includes a gas block port line that is in axial alignment with a gas vent tube located on a barrel of a firearm. The gas block further includes at least one exhaust port fluidly coupled with the gas block port line. Movably secured within the at least one exhaust port is an adjustment screw. The adjustment screw is movable intermediate a first position and a second position so as to facilitate diversion of gas from the gas block at varying volumes.

15 Claims, 2 Drawing Sheets

FIREARM IMPINGEMENT SYSTEM HAVING ADJUSTABLE GAS BLOCK

FIELD OF THE INVENTION

The present invention relates generally to firearms, more specifically but not by way of limitation, rifle impingement systems, both direct gas and gas piston systems wherein the impingement systems of the present invention are operable to include at least one variable exhaust port for diverting a portion of the gas entering the gas block.

BACKGROUND

Rifles such as but not limited to the AR15 utilize impingement systems to cycle the bolt carrier during the firing process. As is known in the art, there are two types of impingement systems. A direct gas impingement system is operably coupled to the barrel of the rifle and includes a port that is operably coupled to the barrel chamber and a gas tube adjacent to the barrel. A portion of the gas created during the firing of a round escapes into the port and is routed back to the bolt carrier, which facilitates the rearward movement thereof. The alternative style of impingement system is a gas piston impingement system. The gas piston impingement system also includes a port that is operably coupled to the barrel but leads to a piston chamber. The piston chamber contains a piston head wherein the piston head includes a piston rod extending therefrom having an end adjacent to the bolt carrier. During the firing process a portion of the gas escapes from the barrel and into the piston chamber which drives the rod rearward towards the bolt carrier in order to facilitate the movement thereof.

One problem with the current impingement systems mentioned herein is the continuous introduction of carbon-laden gas into either the gas tube and firing chamber or the piston chamber. As rounds are fired the accumulation of carbon and other contaminants build up in various areas of the firearm and reduce the effectiveness of its components. Without regular cleaning this can lead to the misfiring or jamming of the rifle during the shooting process.

Another problem with existing impingement systems is there lack of gas control. Both existing types of impingement systems utilize a method of controlling the gas flow from the barrel into the port that controls the input flow of gas into the gas block port of the impingement block. Utilization of this technique results in excess pressure on the impingement system block and excessive heat build-up. This increases the wear on the component and ultimately leads to the early failure thereof.

Accordingly, there is a need for an impingement system for a firearm that is operable to control the release of gas from the impingement block so as to eliminate contaminant build-up in other areas of the firearm and reduce the heating of the impingement block so as to improve the overall performance of the firearm. Additionally, it is desired to have an impingement system that releases excess pressure within the gas block and utilizes an adjustment method operable to provide only sufficient pressure needed for operation of the impingement system.

SUMMARY OF THE INVENTION

It is the object of the present invention to provide an impingement system for a firearm that includes an exhaust port in the block thereof so as to provide a variable means of diverting gas flow entering the block from the barrel of the firearm.

Another object of the present invention is to provide an impingement system for a firearm that includes an impingement assembly utilizing a direct gas technique or a piston technique.

A further object of the present invention is to provide an impingement system for a firearm wherein the exhaust port is operably coupled to the input port from the barrel of the firearm.

An additional object of the present invention is to provide an impingement system for a firearm wherein the impingement system is operable to provide a means for releasing gas therefrom that further includes an adjustment means interfaced with the exhaust port so as to provide variable release of gas from the impingement block.

Yet a further object of the present invention is to provide an impingement system for a firearm that is operable to reduce the contaminant build-up in various areas of the firearm.

Still another object of the present invention is to provide an impingement system for a firearm that utilizes a gas direct or piston technique that further functions to reduce the temperature increase of the impingement block.

To the accomplishment of the above and related objects the present invention may be embodied in the form illustrated in the accompanying drawings. Attention is called to the fact that the drawings are illustrative only. Variations are contemplated as being a part of the present invention, limited only by the scope of the claims.

BRIEF DESCRIPTION OF THE DRAWINGS

A more complete understanding of the present invention may be had by reference to the following Detailed Description and appended claims when taken in conjunction with the accompanying Drawings wherein:

DETAILED DESCRIPTION

Figure 1:
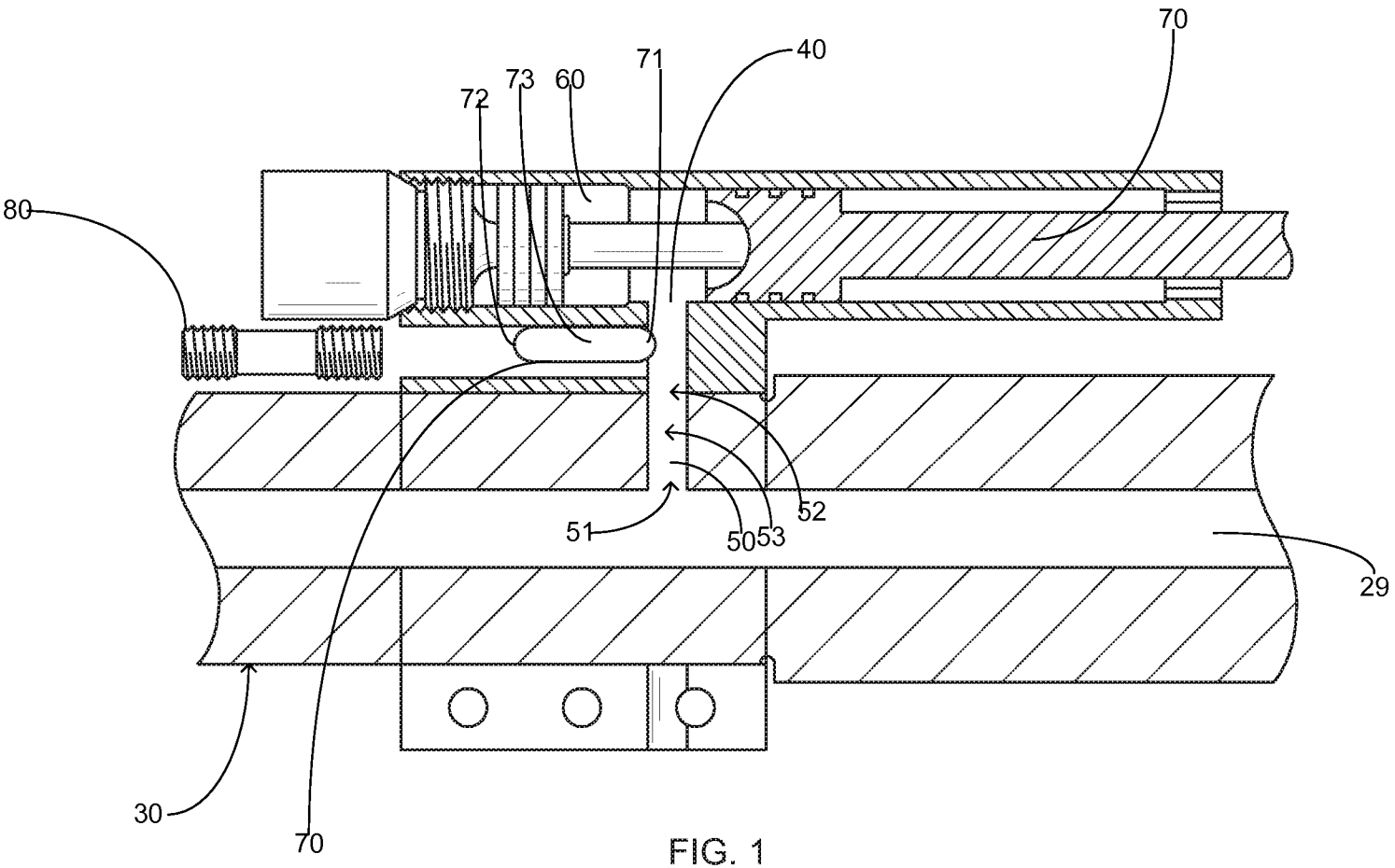
FIG. 1 is a cross-sectional diagrammatic view of the piston impingement system embodiment of the present invention.

Referring now to the drawings submitted herewith, wherein various elements depicted therein are not necessarily drawn to scale and wherein through the views and figures like elements are referenced with identical reference numerals, there is illustrated a firearm impingement apparatus 100 constructed according to the principles of the present invention.

An embodiment of the present invention is discussed herein with reference to the figures submitted herewith. Those skilled in the art will understand that the detailed description herein with respect to these figures is for explanatory purposes and that it is contemplated within the scope of the present invention that alternative embodiments are plausible. By way of example but not by way of limitation, those having skill in the art in light of the present teachings of the present invention will recognize a plurality of alternate and suitable approaches dependent upon the needs of the particular application to implement the functionality of any given detail described herein, beyond that of the particular implementation choices in the embodiment described herein. Various modifications and embodiments are within the scope of the present invention.

It is to be further understood that the present invention is not limited to the particular methodology, materials, uses and applications described herein, as these may vary. Furthermore, it is also to be understood that the terminology used herein is used for the purpose of describing particular embodiments only, and is not intended to limit the scope of the present invention. It must be noted that as used herein and in the claims, the singular forms "a", "an" and "the" include the plural reference unless the context clearly dictates otherwise. Thus, for example, a reference to "an element" is a reference to one or more elements and includes equivalents thereof known to those skilled in the art. All conjunctions used are to be understood in the most inclusive sense possible. Thus, the word "or" should be understood as having the definition of a logical "or" rather than that of a logical "exclusive or" unless the context clearly necessitates otherwise. Structures described herein are to be understood also to refer to functional equivalents of such structures. Language that may be construed to express approximation should be so understood unless the context clearly dictates otherwise.

References to "one embodiment", "an embodiment", "exemplary embodiments", and the like may indicate that the embodiment(s) of the invention so described may include a particular feature, structure or characteristic, but not every embodiment necessarily includes the particular feature, structure or characteristic.

Figure 2:
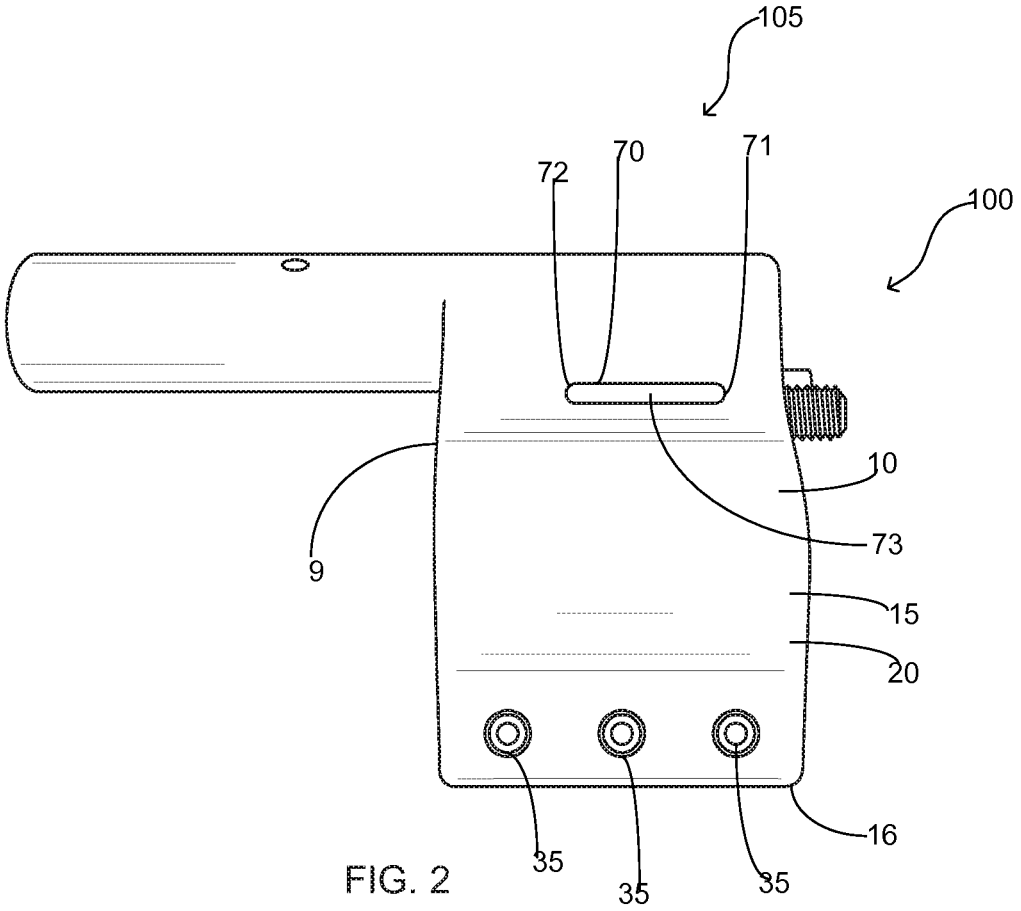
FIG. 2 is side view of the piston impingement system embodiment of the present invention.

Referring in particular to FIGS. 1 and 2 herein, an embodiment of the firearm impingement apparatus 100 is illustrated therein. The embodiment of the firearm impingement apparatus 100 is a piston impingement embodiment 105. The piston impingement embodiment 105 includes gas block 10 that is integrally formed with barrel-mating sleeve 15. The gas block 10 and barrel-mating sleeve 15 are integrally formed utilizing suitable techniques and are manufactured from a suitable durable material such as but not limited to metal. The barrel-mating sleeve 15 is manufactured similarly to conventional barrel sleeves of existing impingement systems wherein the barrel-mating sleeve 15 includes two opposing semi-circular portions 20 (only one portion illustrated herein) that form a passage that is operable to receive a barrel assembly 30 of a firearm therethrough. The semi-circular portions 20 are secured to barrel assembly 30 utilizing fasteners 35 proximate lower edge 16 of barrel-mating sleeve 15. The barrel-mating sleeve 15 is surroundably mounted to a barrel assembly 30 of a firearm wherein the gas block line port 40 bored within the gas block 10 is in axial alignment with gas vent tube 50. Gas vent tube 50 includes hollow passage 53 having openings 51, 52 on opposing ends thereof. Gas vent tube 50 is bored through barrel assembly 30 using conventional techniques and facilitates the fluid communication between the bore 29 of the barrel assembly 30 and the gas block 10.

As a round of ammunition is fired and passes through the bore 29, associated gas also pass through the bore 29 and a portion of the gas propagates into the gas vent tube 50. Gas entering the gas vent tube 50 facilitates the operation of the firearm impingement apparatus 100. Ensuing the firing of a round of ammunition, gas flows from the gas vent tube 50 into the gas block line port 40 and subsequently into the piston chamber 60. As gas flows into the piston chamber 60, the increase in pressure within the piston chamber 60 drives the piston rod 70 rearward wherein the piston rod 70 will operably engage with a conventional bolt carrier of a the firearm to which the piston impingement embodiment 105 (not pictured herein) is operably coupled in order to cycle the bolt carrier to retrieve another round of ammunition into the firing chamber. During the passage of gas from the bore 29 into the gas block line port 40, the expansion of the gas and the temperature thereof creates excessive pressure and wear on the gas block 10. In order to relieve this excessive pressure and reduce the temperature of the gas block 10 during the firing process an exhaust port 70 is present.

The exhaust port 70 is formed within the gas block 10 using suitable techniques and includes end 71 and 72. End 71 is fluidly coupled with gas block line port 40 so as to promote the diversion of a portion of the gas flowing through gas block line port 40. The exhaust port 70 is formed through one side of the gas block 10 and is oval in shape. While in the preferred embodiment illustrated herein the exhaust port 70 is formed through one side of the gas block 10, it is contemplated within the scope of the present invention that a second or third exhaust port could be formed in the opposing side or front edge 9 of the gas block 10 in addition to the exhaust port 70 illustrated herein. Configurations for a single exhaust port or multiple exhaust ports formed within the gas block 10 are contemplated within the scope of the present invention. Furthermore, it is contemplated within the scope of the present invention that the exhaust port 70 could be formed in alternative shapes to then the oval shape illustrated and described herein.

The exhaust port 70 serves to provide a diversion of the gas flow entering the gas block 10 as opposed to limiting the input flow of the gas. Conventional methods of limiting the gas input flow provide no release of the gas, which ultimately expands into additional portions of the bore 29 and further creates excessive pressure and temperature increase of the gas block 10. This method additionally contributes to carbon contamination of the gas block 10. The exhaust port 70 provides a method to release excess pressure within the gas block 10 and utilizes an adjustment method operable to provide only sufficient pressure needed for operation of the firearm impingement apparatus 100. Movably coupled within exhaust port 70 is screw 80. Screw 80 is illustrated herein in its full open position wherein the opening 73 of exhaust port 70 is completely open thus allowing a higher diversion flow rate of gas therethrough. In its first position, screw 80 sealably isolates the gas block line port 40 from exhaust port 70. Screw 80 is movable within exhaust port 70 and is operable to provide variable gas release intermediate its full open position and its full closed position. The variable gas release control provided by the exhaust port 70 and screw 80 provides diversion of a portion of the gas flow entering the gas block line port 40. As previously stated, this reduces the excessive pressure on the gas block 10 and reduces the temperature increase during the firing of rounds of ammunition. This is accomplished through the diversion of the gas instead of merely controlling the incoming gas flow as found in existing impingement systems. The variable release of gas from the gas block 10 provided by the positioning of the screw 80 intermediate its full open position or full closed position provides the ability of a user to more precisely calibrate the desired cycling of the bolt carrier to which the firearm impingement apparatus 100 is coupled. A benefit of the gas diversion instead of gas flow input control is to reduce the amount of carbon-ladened gas that enters the piston chamber 60 thereby reducing the cleaning requirement thereof. Furthermore, good results have been achieved utilizing an exhaust port 70 of the present invention in controlling the trajectory of the firearm shell casings during firing. More specifically, during the sequential firing process of rounds of ammunition, the exhaust port 70 provides a diversion of gas flow such that each shell casing exits the firing chamber at the same trajectory regardless of the grain load of ammunition. The gas diversion technique provided by the exhaust port 70 of the present invention provides an escape of the gases created during the firing process that provides the advantages mentioned herein over mere control of the gas input flow into the gas block 10 thus reducing any back pressure and providing a technique of controlling the shell casing ejection trajectory from the firing chamber regardless of the grain load of the round of ammunition.

Figure 3:
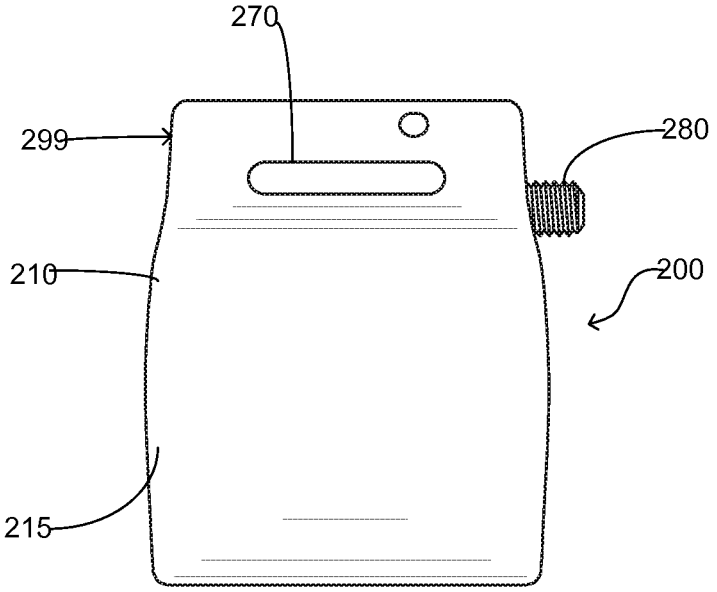
FIG. 3 is side view of the gas impingement system embodiment of the present invention.

Referring in particular to FIG. 3 herein, a gas direct impingement embodiment 200 of the firearm impingement apparatus 100 is illustrated herein. The gas direct impingement embodiment 200 is constructed similarly to the piston impingement embodiment 105 illustrated and described herein. A gas block 210 is integrally formed with barrel-mating sleeve 215 and is releasably secured to a conventional barrel assembly of a firearm. An exhaust port 270 is formed in gas block 210 and includes screw 280 movably coupled therein. The gas direct impingement embodiment 200 functions identically to the piston impingement embodiment 105 and includes all of the internal component thereof with the exception of the piston chamber 60. In the gas direct impingement embodiment 200 the gas not diverted through the exhaust port 270 escapes via an aperture (not illustrated herein) on the front side 299 and travels down a gas tube (not illustrated) herein so as to facilitate the cycling of the bolt carrier of the firearm to which the gas direct impingement embodiment 200. The gas direct impingement embodiment 200 provides all of the benefits and advantages as the piston impingement embodiment 105 described herein.

In the preceding detailed description, reference has been made to the accompanying drawings that form a part hereof, and in which are shown by way of illustration specific embodiments in which the invention may be practiced. These embodiments, and certain variants thereof, have been described in sufficient detail to enable those skilled in the art to practice the invention. It is to be understood that other suitable embodiments may be utilized and that logical changes may be made without departing from the spirit or scope of the invention. The description may omit certain information known to those skilled in the art. The preceding detailed description is, therefore, not intended to be limited to the specific forms set forth herein, but on the contrary, it is intended to cover such alternatives, modifications, and equivalents, as can be reasonably included within the spirit and scope of the appended claims.

What is claimed is:

1. A firearm impingement apparatus comprising:

a gas block, said gas block further including a chamber;

a barrel-mating sleeve, said barrel mating sleeve being integrally formed with said gas block said barrel mating sleeve operably coupling the firearm impingement apparatus to a barrel of a firearm wherein the barrel of the firearm includes a vent tube;

a gas block port line, said gas block port line having a hollow passage, said gas block port line extending through said gas block, said gas block port line having a first end and a second end, said first end of said gas block port line being operably coupled with the vent tube, said second end of said gas block port line being operably coupled to said chamber;

at least one exhaust port, said at least one exhaust port being in fluid communication with said gas block port line, said at least one exhaust port being positioned intermediate the vent tube and the chamber, said at least one exhaust port having an opening, said opening of said at least one exhaust port configured to expel gas externally from the gas block and further including an adjustment screw, said adjustment screw being movably within said at least one exhaust port, said adjustment screw having a first position and a second position, in said first position said adjustment screw being operable to completely close the opening of said at least one exhaust port, in said second position said adjustment screw being operable to completely open the opening of said at least one exhaust port, said adjustment screw operable to vary the size of the opening of the at least one exhaust port intermediate its first position and second position.

2. The firearm impingement apparatus as recited in claim 1, wherein said at least one exhaust port is operable to divert gas flow entering the gas block so as to reduce the temperature and pressure thereof.

3. The firearm impingement apparatus as recited in claim 2, wherein in said first position said adjustment screw sealably isolates the gas block port line from said at least one exhaust port.

4. The firearm impingement apparatus as recited in claim 1, wherein the chamber is a piston chamber configured to receive gas therein so as to operate a piston.

5. The firearm impingement apparatus as recited in claim 4, wherein said at least one exhaust port is oval in shape.

6. A method of diverting gas flow entering a gas block of an impingement apparatus of a firearm comprising:

providing an impingement apparatus, said impingement apparatus having a gas block, said gas block further including a barrel-mating sleeve integrally formed therewith, said gas block further including a piston chamber, said gas block having a gas block port line, said gas block port line having a first end and a second end, said gas block having a first side, a second side and a front end;

coupling said impingement apparatus to a firearm having a barrel, wherein the firearm includes a gas vent tube fluidly coupled to said barrel;

aligning said impingement apparatus wherein said gas block port line and said gas vent tube are in axial alignment so as to be fluidly coupled;

wherein the gas block further includes at least one exhaust port, said at least one exhaust port being intermediate the gas vent tube and said piston chamber, said at least one exhaust port having a first end and a second end, said at least one exhaust port having an opening atmospherically coupled with its environmental surroundings; and diverting a portion of the gas flowing into the gas block port line during firing of the firearm through said at least one exhaust port, wherein said diverting a portion of the gas flowing into the gas block is operable to reduce the volume of gas directed into said piston chamber and further including providing an adjustment screw, said adjustment screw being operably coupled with said at least one exhaust port, said adjustment screw being movably within said at least one exhaust port, said adjustment screw having a first position and a second position, in said first position said adjustment screw being operable to completely close the opening of said at least one exhaust port, in said second position said adjustment screw being operable to completely open the opening of said at least one exhaust port, said adjustment screw operable to vary the size of the opening of the at least one exhaust port intermediate its first position and second position.

7. The method of diverting gas flow entering a gas block of an impingement apparatus as recited in claim 6, and further including reducing the temperature of the gas block during firing of the firearm by diverting the gas flow entering the gas block outward from the gas block into the atmosphere.

8. The method of diverting gas flow entering a gas block of an impingement apparatus as recited in claim 6, and further including varying the flow of gas exiting from said at least one exhaust port, said varying the flow of gas accomplished by adjusting the adjustment screw to a position intermediate its first position and its second position.

9. The method of diverting gas flow entering a gas block of an impingement apparatus as recited in claim 8, and further including controlling trajectory of a shell casing ejecting from a firing chamber of the firearm, wherein the diversion of gas flow outward from the gas block via said at least one exhaust port promotes a consistent trajectory.

10. The method of diverting gas flow entering a gas block of an impingement apparatus as recited in claim 9, wherein in said first position said adjustment screw sealably isolates the gas block port line from said at least one exhaust port.

11. A method of diverting gas flow entering a gas block of an impingement apparatus of a firearm wherein the diversion of gas flow reduces the temperature and contamination of the impingement apparatus during firing of the firearm comprising:

providing an impingement apparatus, said impingement apparatus having a gas block, said gas block further including a barrel-mating sleeve integrally formed therewith, said gas block having a gas block port line, said gas block port line having a first end and a second end, said gas block having a first side, a second side and a front end said gas block further including a gas chamber, said gas chamber operably coupled to said second end of said gas block port line;

coupling said impingement apparatus to a firearm having a barrel, wherein the firearm includes a gas vent tube fluidly coupled to said barrel;

aligning said impingement apparatus wherein said first end of said gas block port line and said gas vent tube are in axial alignment so as to be fluidly coupled;

wherein the gas block further includes an exhaust port, said exhaust port being intermediate the gas vent tube and said gas chamber, said exhaust port having a first end and a second end, said exhaust port having an opening intermediate said first end and said second end, said opening of said exhaust port fluidly coupling the environmental atmosphere with the gas block port line so as to permit gas to egress therefrom, providing an adjustment screw, said adjustment screw being operably coupled with said exhaust port, said adjustment screw being movably within said exhaust port, said adjustment screw having a first position and a second position, in said first position said adjustment screw being operable to completely close the opening of said exhaust port, in said second position said adjustment screw being operable to completely open the opening of said exhaust port, said adjustment screw operable to vary the size of the opening of the exhaust port intermediate its first position and second position;

relieving pressure within said gas block, said relieving pressure facilitated by diversion of a portion of the gas flowing into the gas block such that the portion of the gas does not enter the gas chamber and is expelled to the atmosphere during firing of the firearm wherein the portion of the gas diverted to atmosphere is diverted through said exhaust port;

varying the flow of diverted gas exiting from said exhaust port, said varying the flow of gas accomplished by adjusting the adjustment screw to a position intermediate its first position and its second position.

12. The method of diverting gas flow entering a gas block of an impingement apparatus as recited in claim 11, wherein in said first position said adjustment screw sealably isolates the gas block port line from said exhaust port.

13. The method of diverting gas flow entering a gas block of an impingement apparatus as recited in claim 12, and further including controlling trajectory of a shell casing ejecting from a firing chamber of the firearm, wherein the diversion of gas flow outward from the gas block via said exhaust port promotes a consistent trajectory of an ejected shell casing.

14. The method of diverting gas flow entering a gas block of an impingement apparatus as recited in claim 13, wherein said exhaust port is formed in said gas block in a position selected from one of the following portions of the gas block: the first side, the second side or the front end.

15. The method of diverting gas flow entering a gas block of an impingement apparatus as recited in claim 14, wherein said exhaust port is oval in shape.

* * * * *